US007101195B2

(12) United States Patent
Brooks

(10) Patent No.: US 7,101,195 B2
(45) Date of Patent: Sep. 5, 2006

(54) CONNECTOR

(75) Inventor: Richard Brooks, Hampshire (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/526,789

(22) PCT Filed: Sep. 8, 2003

(86) PCT No.: PCT/GB03/03851

§ 371 (c)(1),
(2), (4) Date: Aug. 4, 2005

(87) PCT Pub. No.: WO2004/023608

PCT Pub. Date: Mar. 18, 2004

(65) Prior Publication Data

US 2006/0128202 A1 Jun. 15, 2006

(30) Foreign Application Priority Data

Sep. 6, 2002 (GB) ..... 0220751.2

(51) Int. Cl.
*H01R 12/00* (2006.01)
*H01R 13/627* (2006.01)

(52) U.S. Cl. ..... 439/70; 439/358

(58) Field of Classification Search ..... 439/70–71, 439/351–353, 356–358
See application file for complete search history.

(56) References Cited

U.S. PATENT DOCUMENTS

| | | | | |
|---|---|---|---|---|
| 5,302,141 | A | 4/1994 | O'Reilly et al. | 439/680 |
| 6,078,756 | A | 6/2000 | Squilla et al. | 396/300 |
| 6,435,882 | B1 * | 8/2002 | Pitou | 439/70 |
| 6,602,089 | B1 * | 8/2003 | Abe et al. | 439/404 |
| 6,953,363 | B1 * | 10/2005 | Kameyama et al. | 439/404 |
| 2002/0101534 | A1 | 8/2002 | Liu | 348/375 |

* cited by examiner

*Primary Examiner*—Tho D. Ta
(74) *Attorney, Agent, or Firm*—Harrington & Smith,LLP

(57) ABSTRACT

A connector for coupling a component to external circuitry, comprising a base, a guide for guiding the component along an axis towards the base, a first barb positioned to latch an edge of the component at a first distance along the axis from the base, and a second barb positioned to latch an edge of the component at a second distance along the axis from the base.

20 Claims, 9 Drawing Sheets

CONNECTOR

This invention relates to a connector for connecting an electrical component such as a digital camera module to external circuitry.

BACKGROUND

Digital camera modules have been developed as components for use in electronic apparatus such as personal digital assistants (PDAs) and mobile telephones.

FIGS. 1 to 4 illustrate such a digital camera module 100. FIG. 1 is a perspective top view of the module, FIG. 2 is a front side view of the module, FIG. 3 is a top plan view of the module, and FIG. 4 is a bottom plan view of the module. The module 100 comprises a substrate 110 and a lens structure 130.

The substrate 110 may be a rectangular-shaped ceramic substrate comprising electronic circuitry including an image sensor 116 on a top surface, and metallic terminals 114 on a bottom surface 112 for electrically coupling the module 100 to external circuitry.

The lens structure 130 comprises a rectangular-shaped base portion 135, and a turret portion 150 extending from the base portion 135. The base portion 135 and the turret portion 150 may both be formed of a plastics material. The turret portion 150 defines an aperture 160 through which light is received into the camera module for detection by the image sensor 116. A lens 170 is positioned within the aperture 160 for focusing received light onto the image sensor 116.

A drawback with known digital camera modules is that they are difficult to connect to printed wiring boards (PWBs). Reflow soldering of the ceramic substrate terminals 114 to a PWB is problematic as the plastics used in the lens 170 melt at temperatures less than the reflow temperatures. Reflow soldering may be possible if the lens is made from a glass material. However, glass lenses are expensive and are less suitable for mass production techniques.

One method for connecting a digital camera module to a PWB involves using a flexible intermediate substrate. The flexible substrate is glued at one end to the bottom surface 112 of the ceramic substrate 110 with locally-conductive adhesive such that the substrate terminals 114 electrically couple to electrical traces in the flexible substrate. The other end of the flexible substrate is then connected to the PWB via a FPC connector. This method is labor intensive and does not lend itself to automated assembly easily.

SUMMARY OF THE INVENTION

According to the present invention there is provided a connector for coupling a component to external circuitry, comprising a base, a guide for guiding the component along an axis towards the base, a first barb positioned to latch an edge of the component at a first distance along the axis from the base, and a second barb positioned to latch an edge of the component at a second distance along the axis from the base.

A connector in accordance with the invention has the advantage that it is able to receive components along one axis which in turn enables simple assembly of the component to the connector. A connector in accordance with the invention also has the advantage that it is able to receive components that have housings of different height due to the two barb arrangement. In other words, the two barb arrangement enables a component to be retained by an edge of the component even when the height of that edge varies.

The component is preferably a digital camera module.

Suitably, the base includes electrical interconnects for coupling to the component/digital camera module.

Preferably, the guide comprises side walls extending from a planar base.

BRIEF DESCRIPTION OF THE DRAWINGS.

Embodiments of the invention will now be described in more detail, by way of example, with reference to the enclosed drawings, in which.

DESCRIPTION OF THE PREFERRED EMBODIMENT

Figure 5:
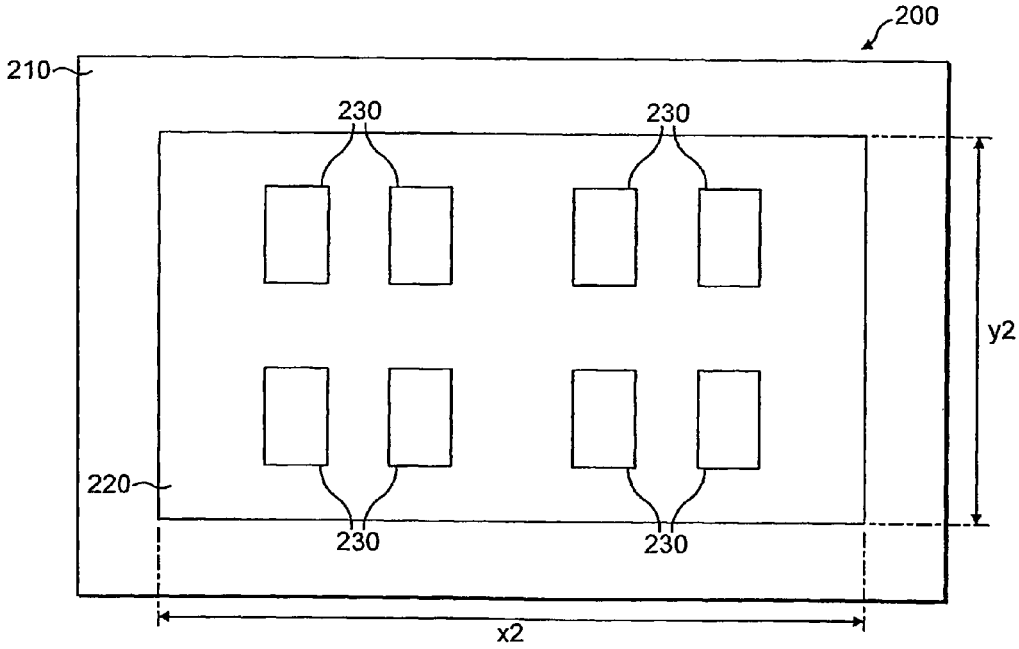
FIG. 5 is a plan view of a connector in accordance with the invention.

FIG. 5 is a plan view of a connector 200 in accordance with the invention. The connector is made of a plastics material and is shaped generally like box having an open top. The connector 200 is further illustrated in FIGS. 6 and 7, which show a side view and an end view respectively.

The connector 200 comprises a generally planar base portion 220 and four side walls 210 extending perpendicular to the base to form the open box shape.

Figure 1:
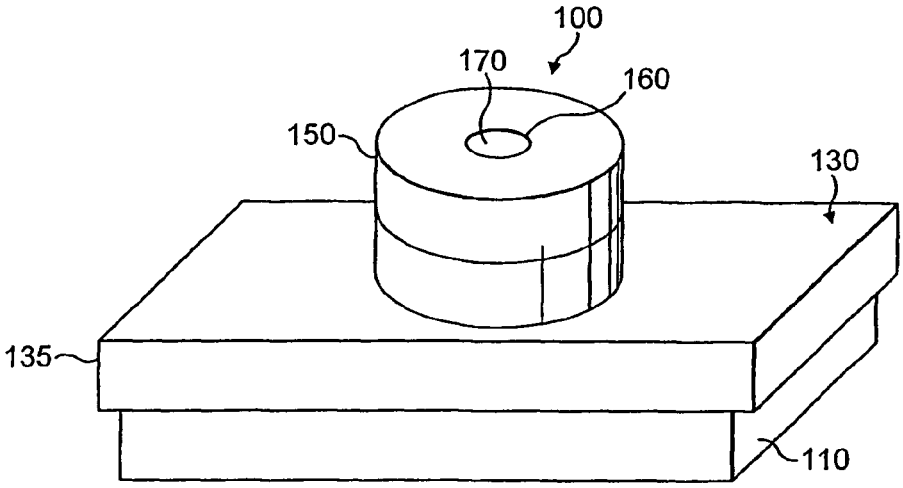
FIG. 1 is a perspective top view of a camera module.
Figure 6:
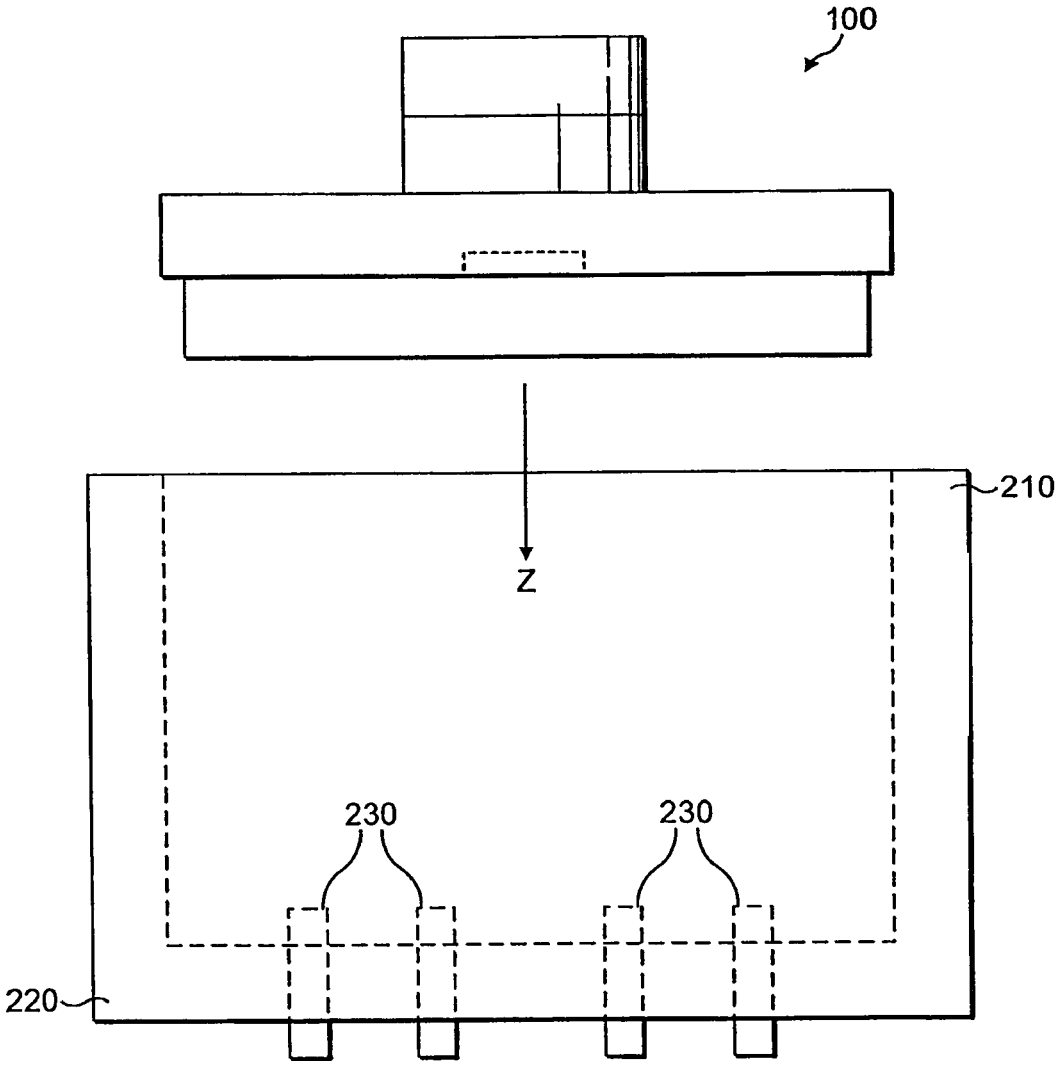
FIGS. 6 and 7 are side views of the connector and the module.
Figure 7:
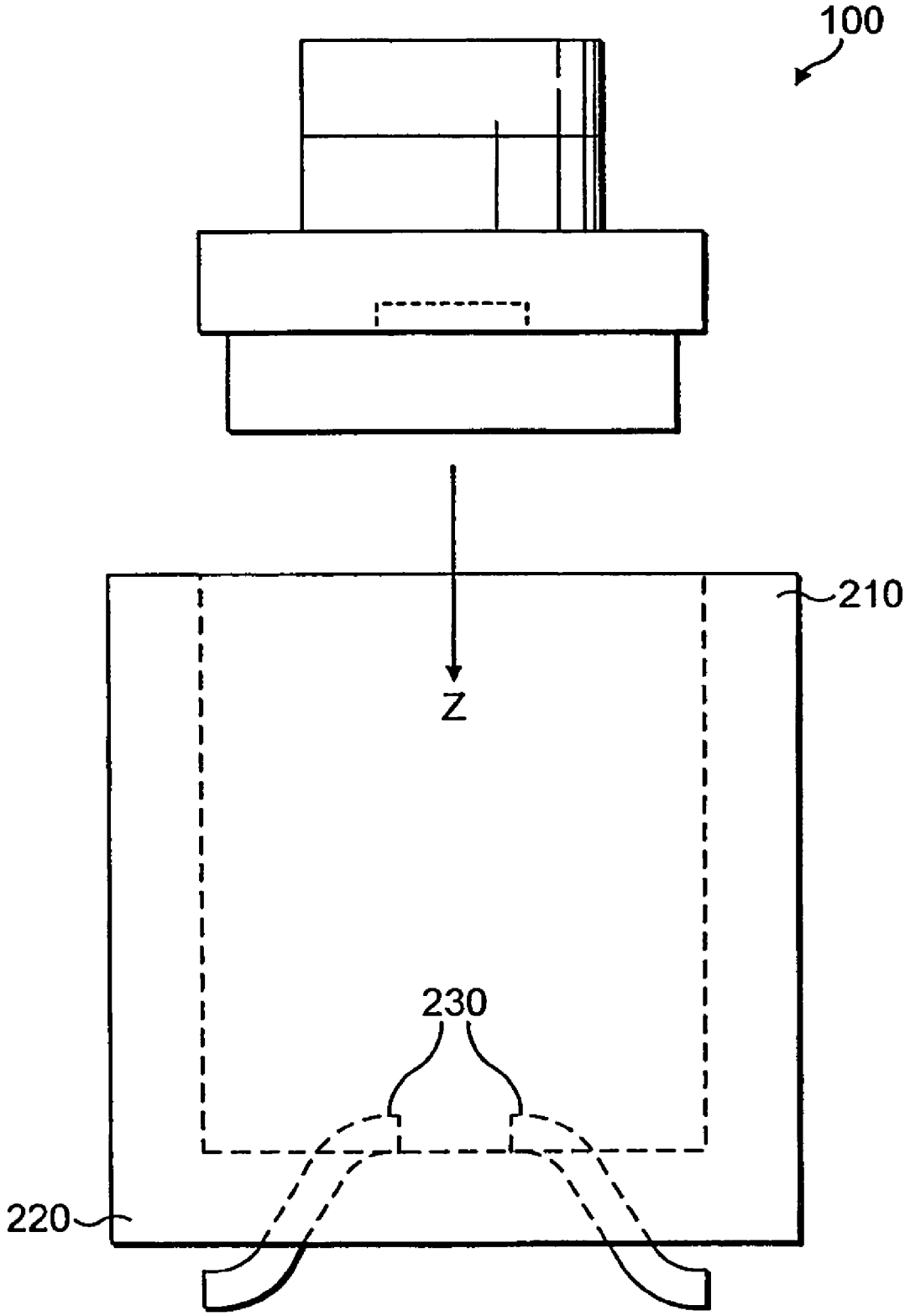

As shown in FIG. 6, the connector 200 is designed to receive the camera module 100 of FIG. 1 along the Z-axis. Eight electrical interconnects 230 made of metal such as copper are embedded into the base 220 such that each interconnect has a internal portion extending to the inside of the box, and a external portion extending to the outside of the box. The internal portions are designed to couple to the terminals 114 of the camera module once it has been fully inserted into the connector 200. The external portions are designed to be soldered to traces of a PWB (not shown) in order to provide electrical connections to external components. The connector 200 is preferably reflow soldered to the PWB before the camera module 100 is received into the connector. Other types of connection between the external portions and the PWB may also be used, such as pin and socket type connections.

In an alternative embodiment, the internal portions of the interconnects may extend up the side walls 210 to couple with correspondingly positioned terminals on the camera module.

Figure 4:
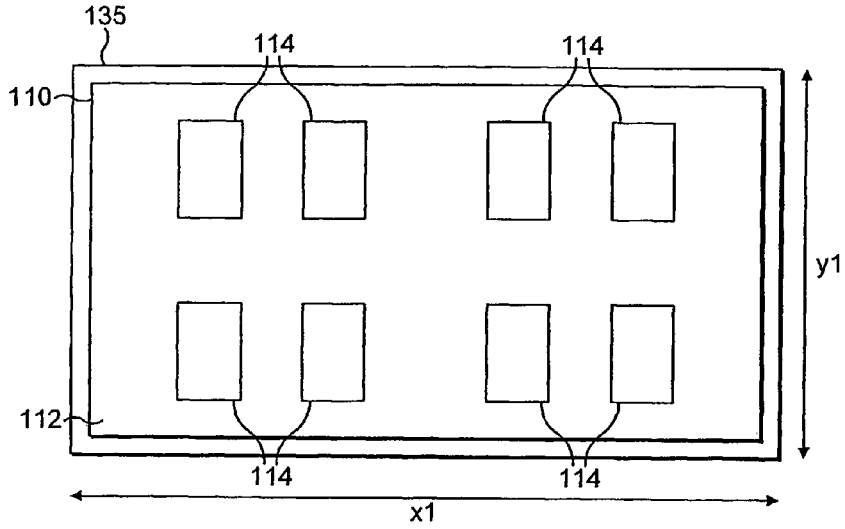
FIG. 4 is a bottom plan view of the module.

As shown in FIGS. 4 and 5, the external dimensions x1 and y1 of the rectangular-shaped base portion 135 of the camera module 100 are slightly smaller than the internal dimensions x2 and y2 of the connector box opening defined by the side walls 210. The side walls 210 thus act as guides to guide the camera module 100 into the connector along the Z-axis.

Figure 8:
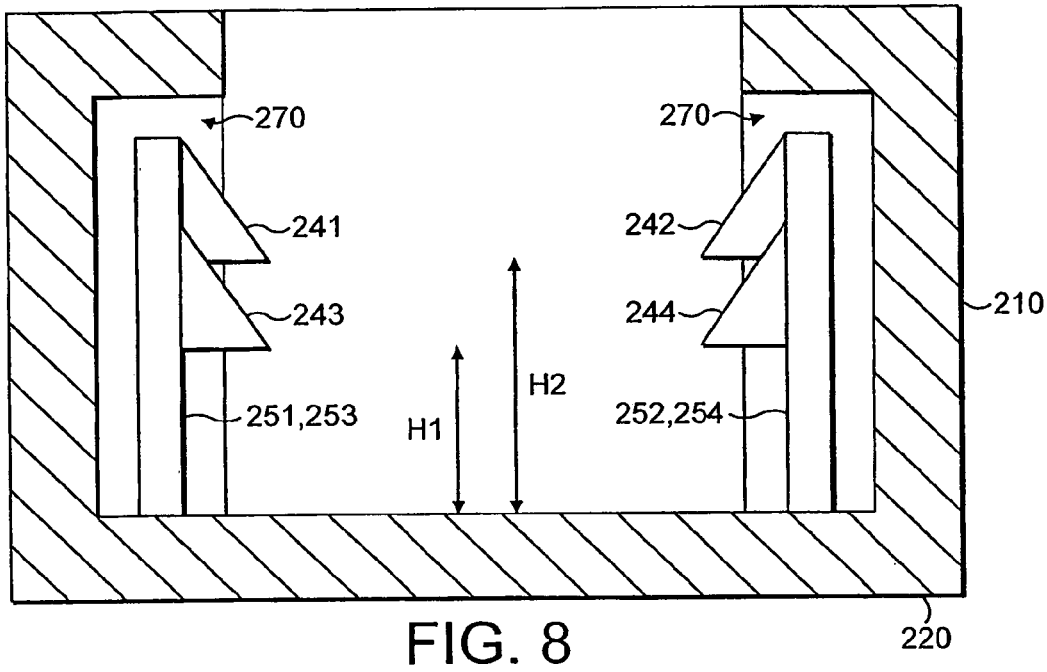
FIG. 8 is a cross-sectional side view of the connector illustrating the position of retaining barbs.

It is important that the camera is held in the connector so that the terminals 114 remain coupled to the interconnects 230. FIG. 8 illustrate the barbs that form part of the connector 200 to achieve this function. The barbs need not be exactly the pointed shape illustrated in the Figures so long as they function to hold the camera module at the desired position. Accordingly, the term barb is intended to encompasses more rounded shapes than those illustrated.

Figure 9:
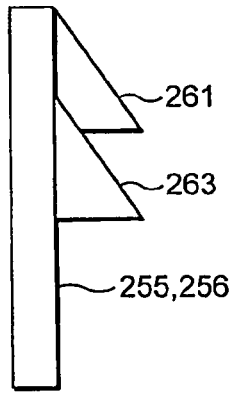
FIG. 9 is side view of two barbs.
Figure 10:
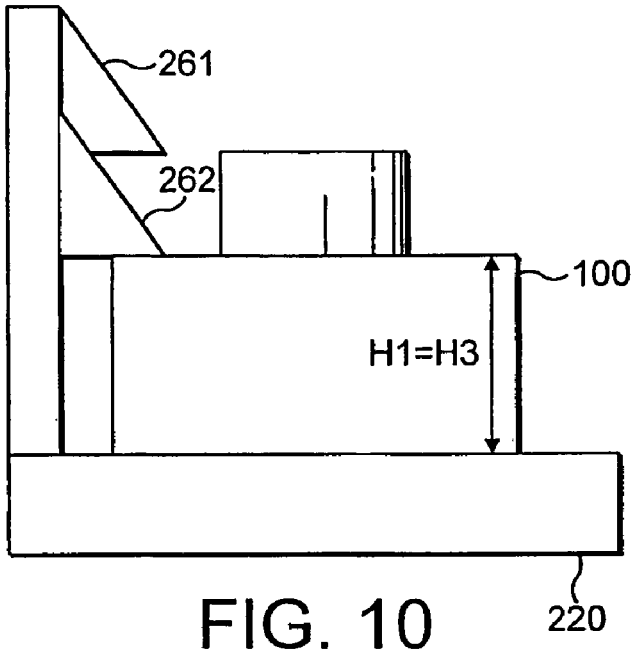
FIGS. 10 and 11 are schematic side views of the two barbs operating against a camera module.
Figure 11:
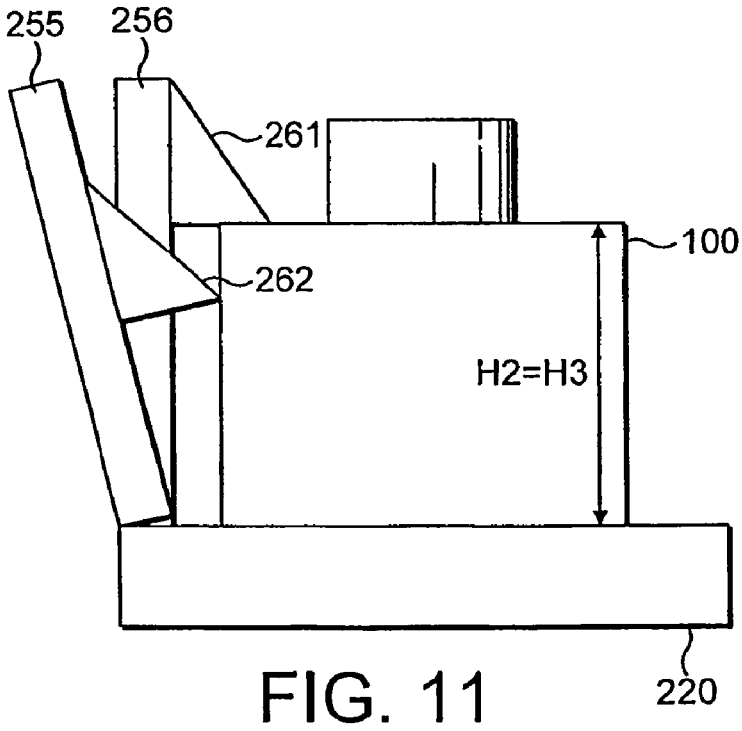
Figure 12:
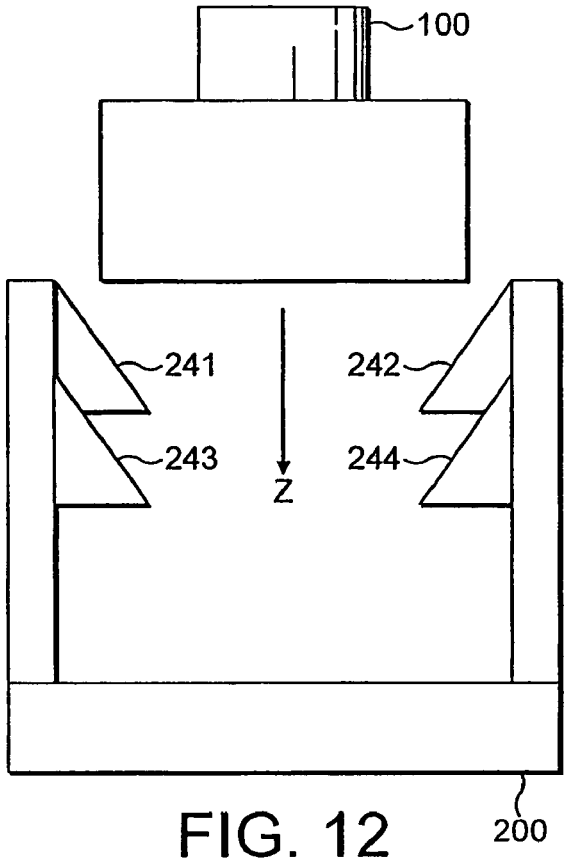
FIGS. 12 to 17 are schematic side views of the four barbs of FIG. 8 operating against a camera module.
Figure 13:
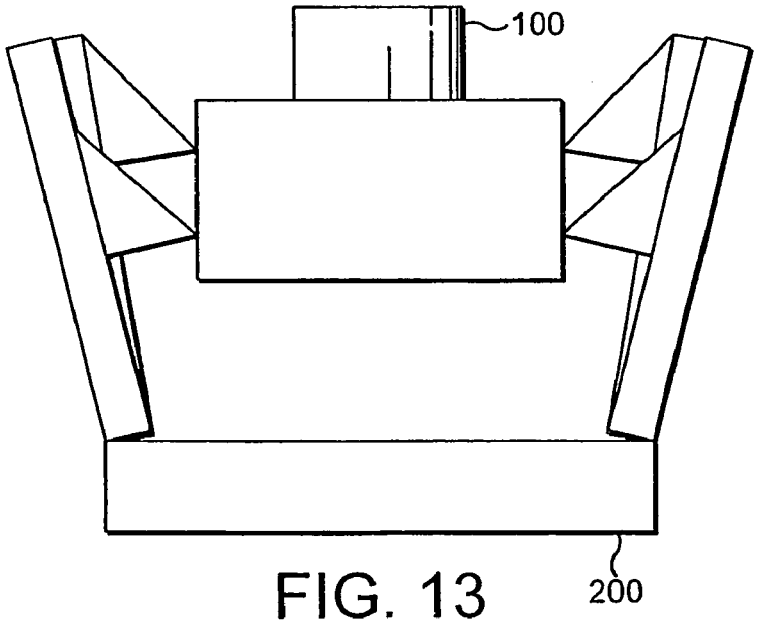
Figure 14:
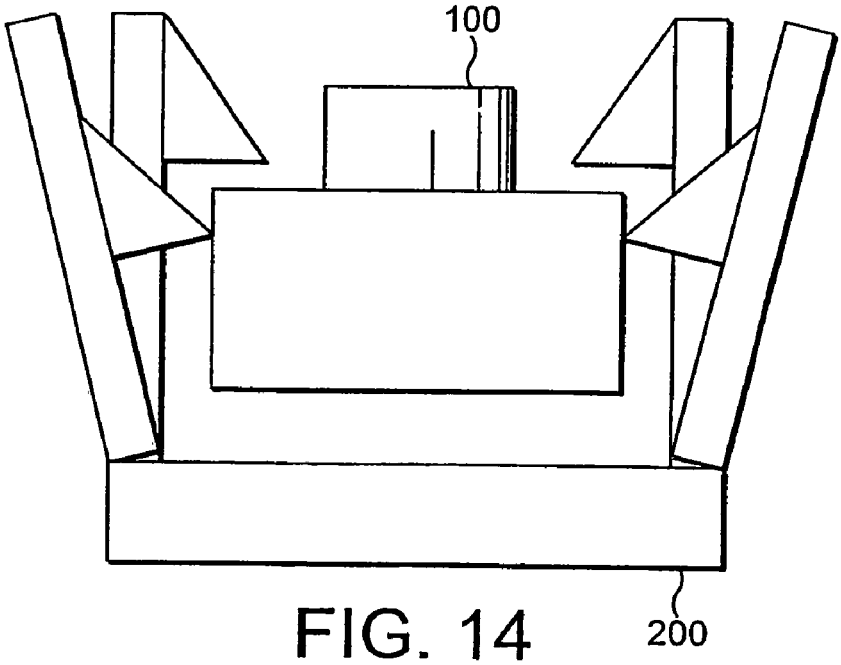

FIGS. 8 and 12 to 17 illustrate an embodiment of the connector with four barbs 241, 242, 243, 244. An alternative embodiment of the connector with just two barbs is illustrated in FIGS. 9 to 11. The barbs are supported by arms 251–254 that extend from the base 220 of the connector. The arms are coupled to the base 220 such that they can move independently of each other. Recesses 270 in the side walls 210 allow the arms and barbs to spring back as the camera module is received into the connector 200.

In FIG. 8, the two lower barbs 243, 244 of the of four barbs are positioned at a distance H1 from the base 220, while the two upper barbs 241, 242 are positioned at a distance H2 from the base 220.

Figure 2:
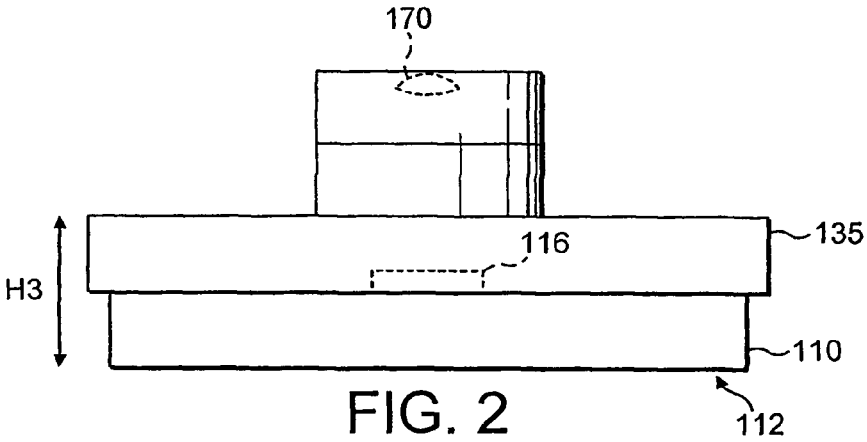
FIG. 2 is a front side view of the module.
Figure 3:
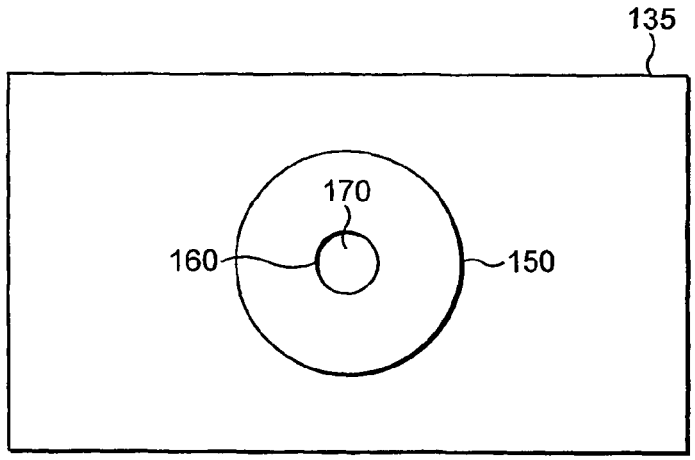
FIG. 3 is a top plan view of the module.

The height of the camera module H3 (see FIG. 2) is known to have a large tolerance due to variations in the alignment of the lens structure 130 to the substrate 110. The use of barbs at different heights enables the connector 200 to receive and retain camera modules that vary greatly in height. Preferably the upper barb is positioned at a height H2 that is near the maximum tolerance for H3 while the lower barb is positioned at a height H1 that is near the minimum tolerance for H3.

FIG. 11 illustrates how the connector 200 according to the invention can retain a camera module 100 that has a large height H3 by means of the upper barb 261. The lower barb 262 is simply deflected out of the way. FIG. 10 in contrast illustrates how the connector 200 according to the invention can retain a camera module that has a smaller height H3 by means of the lower barb 262.

Figure 15:
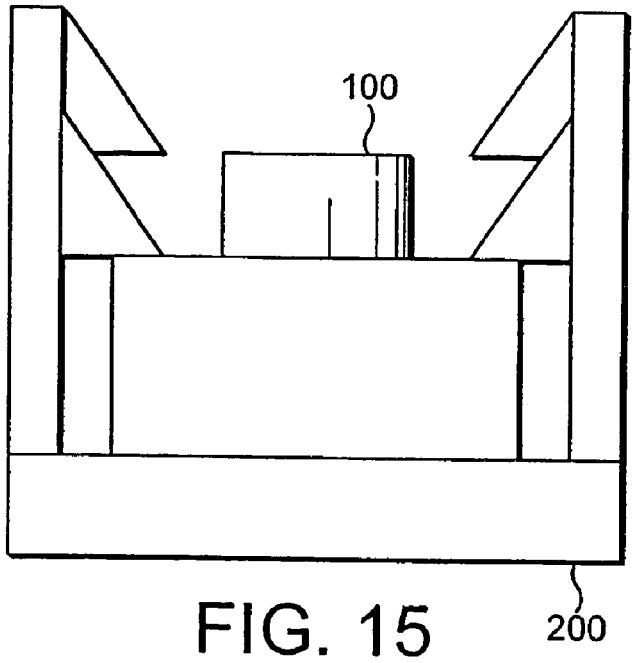
Figure 16:
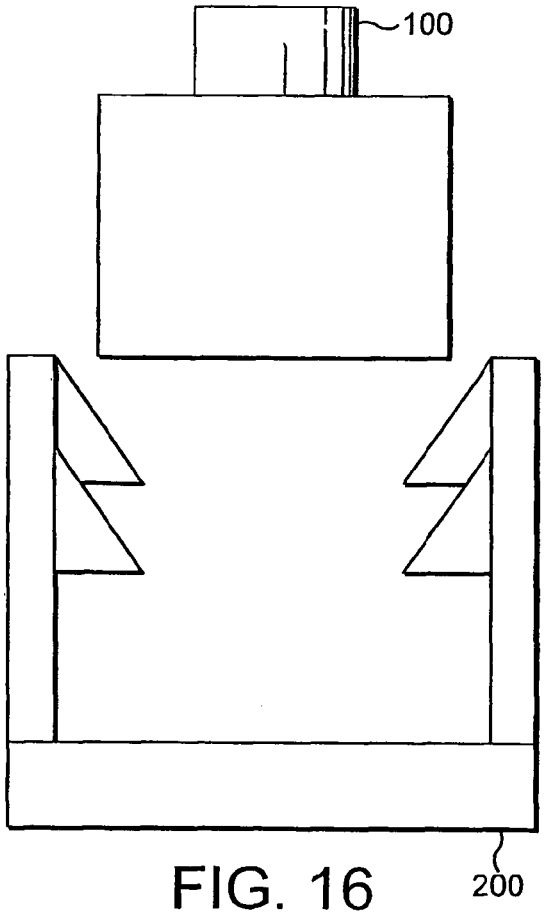
Figure 17:
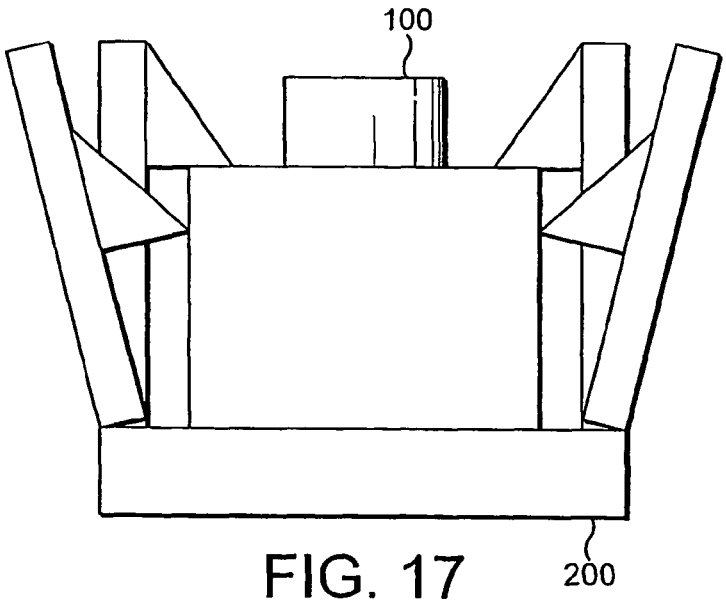

FIGS. 12 to 15 illustrate the sequence of deflections of the four barbs 241–244 (originally shown in FIG. 8) as a camera module 100 with a small height is received by the connector 200 along the vertical z-axis. FIGS. 16 and 17 illustrate a similar sequence for a camera module 100 with a larger height. FIGS. 15 and 17 illustrate the camera module 100 fully inserted and retained in the connector 200.

In accordance with the invention, further barbs may be added at heights other than H1 and H2 to accommodate further variations in the height H3 of the camera module, or to engage different edges of the camera module.

Other components that may be retained by the connector include, for example, lamps, laser diodes etc.

The invention claimed is:

1. An electrical connector for coupling an electronic component to external circuitry, comprising a base, a guide for guiding the electronic component along an axis towards the base, a first barb positioned to latch an edge of the electronic component at a first distance along the axis from the base, and a second barb positioned to latch an edge of the electronic component at a second distance along the axis from the base, wherein the second distance is different to the first distance.

2. A An electrical connector as claimed in claim 1, wherein the component is a digital camera module.

3. A An electrical connector as claimed in claim 1, wherein the base includes electrical interconnects for coupling to the component.

4. A An electrical connector as claimed in claim 1, wherein the base is generally planar.

5. An electrical connector as claimed in claim 1, wherein the second distance is greater than the first distance and the second barb is positioned substantially above the first barb.

6. An electrical connector as claimed in claim 1, wherein when the electronic component has an exterior dimension corresponding to the first distance, it is automatically retained on movement towards the base by the first barb and not the second barb, and when the electronic component has an exterior dimension corresponding to the second distance, it is automatically retained on movement towards the base by the second barb and not the first barb.

7. An electrical connector as claimed in claim 1, wherein the first and second barbs are resiliently biased.

8. A An electrical connector as claimed in claim 1, wherein the guide comprises a side walls extending from the base.

9. An electrical connector as claimed in claim 8, wherein a portion of the side wall is positioned a third distance from the base, the third distance being greater than the second distance, and the second distance being greater than the first distance.

10. An electrical connector as claimed in claim 9, wherein the portion of the side wall is positioned substantially above the first and second barbs.

11. A connector for coupling a component to a base, comprising a first retainer positioned at a first distance from a base, and a second retainer positioned at a second distance from the base, the second distance being different to the first distance, wherein when a component has an exterior dimension corresponding to the first distance, it is automatically retained on movement towards the base by the first retainer and not the second retainer, and when a component has an exterior dimension corresponding to the second distance, it is automatically retained on movement towards the base by the second retainer and not the first retainer.

12. A connector as claimed in claim 11, wherein the connector is an electrical connector and the component is an electronic component.

13. A connector as claimed in claim 11, wherein the first and second retainers are resiliently biased.

14. A connector as claimed in claim 11, further comprising a guide for guiding the electronic component towards the base.

15. A connector as claimed in claim 14, wherein the guide comprises a side wall extending from the base and a portion of the side wall is positioned a third distance from the base, the third distance being greater than the second distance, and the second distance being greater than the first distance.

16. A connector as claimed in claim 15, wherein the portion of the side wall is positioned substantially above the first and second barbs.

17. A connector for electrically connecting an electronic component to external circuitry, comprising a base, a first latch positioned to latch an edge of an electronic component at a first distance from the base, to hold an electronic component in electrical connection with the external circuitry, and a second latch positioned to latch an edge of an electronic component at a second distance from the base, to hold an electronic component in electrical connection with the external circuitry, wherein the second distance is different to the first distance.

18. An connector as claimed in claim 17, wherein when an electronic component has an exterior dimension corresponding to the first distance, it is automatically retained on movement towards the base by the first latch and not the second latch, and when an electronic component has an exterior dimension corresponding to the second distance, it is automatically retained on movement towards the base by the second latch and not the first latch.

19. A connector as claimed in claim 17, further comprising a guide for guiding the electronic component towards the base, wherein the guide comprises a side wall extending from the base and a portion of the side wall is positioned a third distance from the base, the third distance being greater than the second distance, and the second distance being greater than the first distance.

20. A connector as claimed in claim 19, wherein the portion of the side wall is positioned substantially above the first and second latches.

* * * * *